United States Patent [19]

West

[11] Patent Number: 4,691,668

[45] Date of Patent: Sep. 8, 1987

[54] ENGINE COOLING SYSTEMS

[75] Inventor: John G. W. West, Pershore, England

[73] Assignee: Lucas Electrical Electronics and Systems Limited, Birmingham, England

[21] Appl. No.: 754,729

[22] Filed: Jul. 15, 1985

[30] Foreign Application Priority Data

Aug. 2, 1984 [GB] United Kingdom ..... 8419784

[51] Int. Cl.[4] ..... F01P 5/02; F01P 5/10

[52] U.S. Cl. ..... 123/41.12; 123/41.44; 123/41.49

[58] Field of Search ..... 123/41.11, 41.12, 41.44, 123/41.46, 41.49

[56] References Cited

U.S. PATENT DOCUMENTS

| | | | |
|---|---|---|---|
| 1,662,723 | 3/1928 | Snow . | |
| 1,900,586 | 3/1933 | Rippe | 123/41.12 |
| 2,019,476 | 11/1935 | Brownlee . | |
| 4,409,933 | 10/1983 | Inoue | 123/41.49 |
| 4,423,705 | 1/1984 | Morita et al. | 123/41.44 |
| 4,475,485 | 10/1984 | Sakakibara et al. | 123/41.44 |
| 4,489,242 | 12/1984 | Worst | 123/41.46 |
| 4,491,094 | 1/1985 | Ogawa | 123/41.49 |
| 4,557,223 | 12/1985 | Gueyen | 123/41.44 |

FOREIGN PATENT DOCUMENTS

| | | |
|---|---|---|
| 0084378 | 7/1983 | European Pat. Off. . |
| 2388994 | 11/1978 | France . |
| 2455174 | 11/1980 | France . |
| 2041677 | 2/1980 | United Kingdom . |
| 2064817 | 6/1981 | United Kingdom . |

OTHER PUBLICATIONS

Patents Abstracts of Japan, vol. 7, No.50, (M-197) [1195], 26 Feb. 1983, Nippon Radiator K.K.

European Search Report, EP 85 30 4875, Annex to the European Search Report on European Patent Application No. EP 85 304875.

*Primary Examiner*—William A. Cuchlinski, Jr.

*Attorney, Agent, or Firm*—Stevens, Davis, Miller & Mosher

[57] ABSTRACT

Cooling system, particularly for vehicle engines, includes a coolant circulation pump (21) and a cooling fan (20) typically coacting with a radiator (14) both driven by a common variable speed motor (18) whereby both the pump and fan can be operated at lower and higher speeds in response to the sensed temperature levels of the coolant.

10 Claims, 6 Drawing Figures

ENGINE COOLING SYSTEMS

This invention relates to cooling systems for heat-engines, particularly but not exclusively water cooled internal combustion engines of road vehicles. More specifically it is concerned with systems including a pump for forced circulation of coolant (commonly water or a mix of water and other liquids such as anti-freeze compounds though the invention contemplates use with other liquid coolants) and at least one fan for assisting in dispersion of heat from the coolant to atmosphere at least under certain operating conditions of the engine; typically the fan acts in conjunction with a radiator or other heat exchanger.

One common form of vehicle engine cooling system incorporates a rotary water pump for forced circulation of coolant and a fan driven in common with the pump by a Vee belt from a pulley mounted on the front end of the engine crank shaft, said belt also being commonly employed to drive a generator (dynamo or alternator), the speed of the pump, fan and generator thus being directly related to the operating speed of the engine and all these components being continuously driven whenever the engine is running.

In another known arrangement which has become increasingly common particularly for vehicles having transversely mounted engines, an electrically driven cooling fan is provided which can be mounted as convenient independently of engine layout e.g. to act in conjunction with a radiator at the front of the engine compartment. Said fan may be run continuously or may be thermostatically controlled so that it operates only when the temperature of the coolant rises above a predetermined level. However, the Vee belt drive arrangement remained unchanged in this case, the water pump and generator being driven from the engine crank shaft pulley as before. A thermostatically controlled variable speed electric fan is described in British patent specification No. 2041677A. The performance of the above known arrangements will be discussed in greater detail below with reference to FIGS. 5 and 6 of the accompanying drawings.

It has also been proposed to use an electrically driven circulating pump in a vehicle engine cooling system, for example European patent application No. 84378A, and French patent application Nos. 2388994 and 2455174, these arrangements also utilising an independent electrically driven cooling fan, both the fan and pump motors being variable speed units controlled in accordance with coolant temperature.

Another proposal is described in U.S. Pat. No. 4,423,705 where an engine is provided with two coolant circulating systems for respective high and low temperature portions of the engine each having its own motor driven circulating pump automatically controlled relative to the cooling requirements of the engine.

While these latter proposals show some improvement in terms of operating efficiency and flexibility of engine and component layout over systems in which the circulating pump and cooling fan are constantly belt driven from the engine they retain or add to the number of components required so that the overall complexity of the system remains, there may not be any saving in equipment costs, and the increase in overall efficiency as by reducing unnecessary power losses may be small.

The object of the invention is to provide improvements over these known constructions.

A. According to a first aspect of the invention there is provided an engine cooling system including a pump for forced circulation of coolant in a coolant flow circuit of the engine and a cooling fan for assisting in dispersal of heat from the coolant, for example through a radiator or other heat exchanger, the pump and fan being driven by a common electric pump/fan motor, and control means including sensor means responsive to temperature of the coolant in use and means for controlling the operation of the motor automatically as a function of said temperature.

B. Preferably said motor is a variable speed motor.

C. According to a second aspect of the invention a pump unit for use in an engine cooling system comprises a variable speed pump/fan electric motor drivingly coupled to a coolant circulating pump and a cooling fan.

D. According to another aspect of the invention there is provided a vehicle engine cooling system including a coolant circulation pump, a radiator or other means for exchange of heat from the coolant to atmosphere, a fan for inducing airflow assisting said exchange of heat, said airflow being in the same direction as airflow induced by movement of the vehicle in operation, and a motor selectively operable to drive both the pump and fan independently of the speed of the engine; the fan and pump being drivingly connected, for example by a common drive shaft of the motor, so that the fan provides a driving force to the pump in use at least during movement of the vehicle at medium to high speeds supplementing the drive from the motor.

E. The invention further provides an internal combustion engine having a cooling system or pump unit as defined by paragraphs A, B, C or D.

The variable speed motor may be a two-speed motor, for example a three brush motor, operating at a low speed when the coolant is below a first predetermined temperature and at a high speed when it is above that temperature. The system may be arranged so that at or below a second predetermined temperature substantially below the first temperature the motor is switched off or held inoperative so that there is no forced circulation or fan cooling in a lowermost temperature range.

Other forms of two or multi-speed or continuously variable speed motors might be employed, for example incorporating transistor or other electronic speed controls and for some systems the operation of the pump associated fan may be supplemented by one or more additional cooling fans driven independently, e.g. by their own respective motors, and controlled in conjunction with or independently of the pump/fan motor.

In some applications switching arrangements may be incorporated so that the pump/fan motor continues to run with coolant temperature above a predetermined level even when the engine is not running e.g. by powering the motor from a battery so that the engine will be efficiently cooled when stopped after a period of high temperature running.

Embodiments of the invention will now be more particularly described by way of example with reference to the accompanying drawings wherein.

Figure 1:
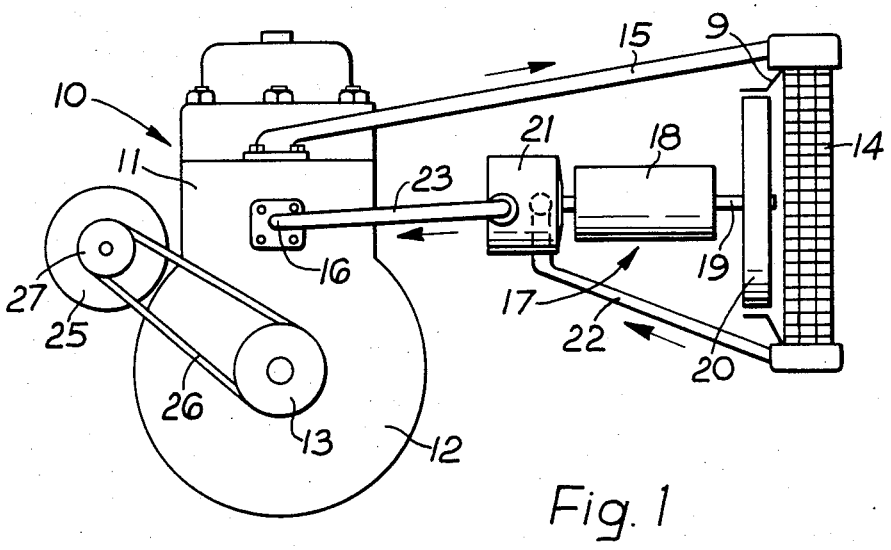
FIG. 1 is a diagrammatic elevation of an engine cooling system incorporating the invention.

Referring to FIG. 1 a vehicle internal combustion engine 10 is shown diagrammatically in end elevation having a cylinder block 11, crank case 12 and crank shaft mounted drive pulley 13 in conventional manner. The engine is water cooled and, in this example, is assumed to be mounted transversely in a vehicle.

The cooling system for the engine includes a radiator 14 which can be mounted at any convenient position or level. The top of radiator 14 is connected to the top of the water jacket of block 11 by a top hose 15 or other duct in conventional manner. Block 11 in this example is provided with an inlet connection 16 on the front end face in the position occupied by a bolt-on belt driven water pump in cooling systems commonly used hitherto.

A pump and fan unit 17 comprises an electric pump/-fan motor 18 (described in greater detail hereafter) having a double ended drive shaft 19 one end of which drives a directly mounted cooling fan 20 adjacent the rear face of radiator 14 and the other end of which is directly coupled to a rotary impeller type water pump 21 of unit 17.

The radiator 14 will preferably be disposed to take advantage of airflow derived from forward motion of the vehicle in assisting heat transfer, for example by being mounted to face the front of the vehicle or being positioned in ducting or the like along which such airflow is directed, and the fan will operate to induce airflow through the radiator in the same direction. It follows that airflow caused by forward motion will itself cause or assist the fan to rotate at least at higher vehicle speeds and as the fan is drivingly connected to the pump through shaft 19 the fan itself will provide a driving force to the pump supplementing the drive from motor 18. Cowling 9 on the back of radiator 14 and closely surrounding fan 20 ensures that there is minimal spillage of airflow past the fan periphery.

An inlet connection of pump 21 is connected to the bottom of radiator 14 by a bottom hose 22 or other duct while an outlet connection of the pump is connected by a hose or other duct 23 to the inlet connection 16 of the cylinder block.

Unit 17 can be mounted at any position in conjunction with radiator 14, thus the layout of the engine and its anciliaries and, indeed, the arrangement of water circulation through the engine, need not be dictated by the need to drive a fan and/or water pump from the front crank shaft pulley 13 or the need to mount the pump on the front end of block 11.

Pulley 13 drives only a generator 25 (dynamo or alternator), which in this diagram is shown mounted to one side of the engine by means of a Vee belt 26. It is to be noted that this belt does not have to drive any other equipment or be led round any pulleys other than a generator pulley 27 and pulley 18.

If auxiliary drives are required to be taken from the front end of the engine or other auxiliary units are required to be mounted thereon, for example pumps for power steering or air-conditioning these can be arranged at the front of the engine much more easily (having in mind the possible need to also accommodate drive for an overhead cam shaft or cam shafts of the engine) as the water pump and fan unit 17 can be positioned well clear of this area.

Figure 2:
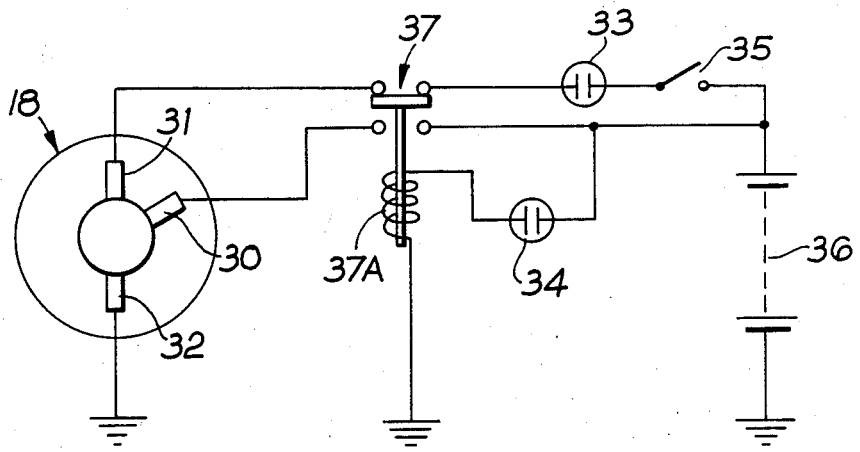
FIG. 2 is an electrical circuit diagram of the motor and control for the system of FIG. 1.

One form of pump/fan motor 18 and the electrical connections and controls thereof are shown diagrammatically in FIG. 2. In this example motor 18 has two operating speeds, provided by means of a third brush. Preferably the third brush 30 spans 120° (two thirds of the armature conductors) so theoretically increasing the no-load speed of the motor by 50% over the speed attained by the normal running brush 31 which is positioned at 180° from the common and, in this circuit, earthed brush 32 of the other pole connection of the motor.

The "built-in" difference between the normal and fast sppeds may be varied depending on the positioning of brush 30, a third brush spanning only 90° of the commutator would theorectically provide a no-load speed double the normal speed but with this latter arrangement there is loss in efficiency and there is a practical limit to the speed increase that can be obtained by the third brush method. However this type of motor is an economical way of providing two spped operation.

In this example motor 18 is controlled by two temperature responsive switches 33, 34 which react thermostatically to the sensed temperature of the coolant at some convenient point or points in the coolant flow circuit.

The first switch 33 is connected through the ignition switch 35 of the electrical circuitry of the vehicle to the battery 36 and this switch closes when coolant temperature approaches a normal operating level, for example 70° C. This switch is connected to the normal running brush 31 of motor 18 through a normally closed pair of contacts of a changeover relay 37. Thus motor 18 does not run to operate pump 21 and fan 20 during engine warm-up or under cool operating conditions unless and until coolant temperature reaches the normal operating level.

The second switch 34 is connected direct to battery 36 bypassing the ignition switch 35 and is in circuit with the solenoid 37A of relay 37. Switch 34 is arranged to close when coolant temperature reaches a safe maximum, for example 80° C. A second pair of contacts of relay 37, which are closed by the operation of solenoid 37A as the first pair of contacts are opened, make connection between the third brush 30 of motor 18 and the connection of switch 34 to the battery 36. Thus when the coolant temperature reaches the safe maximum of 80° C. switch 34 operates solenoid 37A to change over the contacts of relay 37 isolating the normal running brush 31 and energising the third brush 30. This increases the speed of motor 18 substantially causing pump 21 and fan 20 to run faster and provide greater cooling for the engine; for example when the latter is operating under substantial load and/or adverse conditions such as high altitude hill-climbing in low gear at moderate speed, or slow speed travel in heavy traffic with a heavily loaded vehicle during hot weather.

The "high speed" mode of operation is provided independently of the ignition switch 35 to enable the pump and fan to continue to operate at the high speed after the engine has been stopped, e.g. when the vehicle is parked with a very hot engine, so as to provide continued cooling and avoid the effects of "soak-back" of engine heat which might otherwise temporarily increase coolant temperature to excessive levels. As soon as the engine has cooled sufficiently switch 34 will open and motor 18 will stop.

Figure 4:
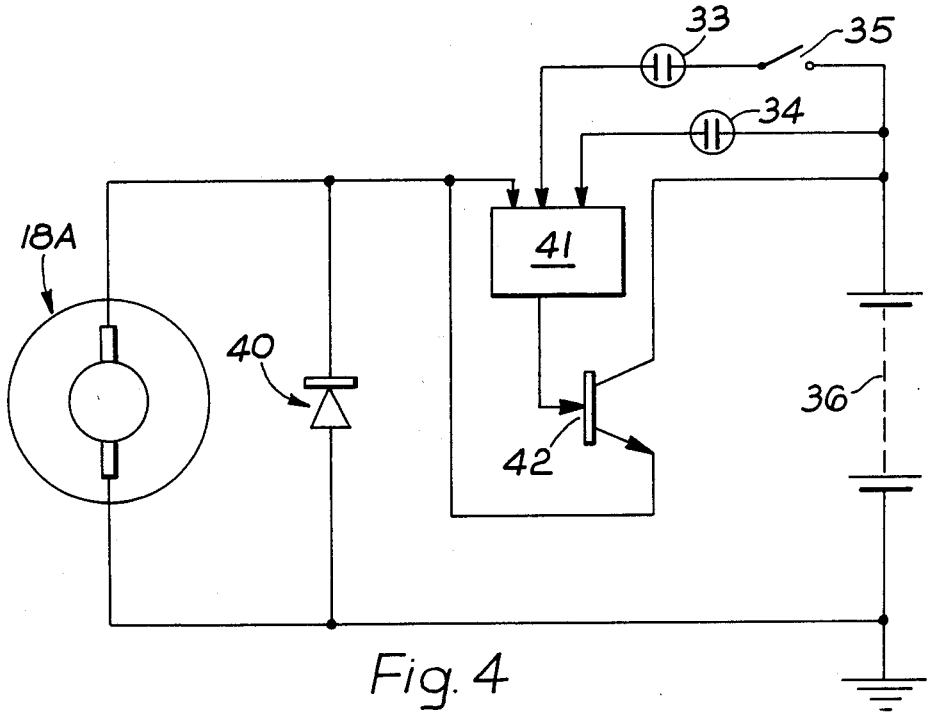
FIG. 4 is a circuit diagram of an alternative form of motor and control arrangement.

Instead of the three brush variable speed pump/fan motor described above other forms of dual or multi-speed or continuously variable speed electric motors may be used. One example of such an arrangement is shown in FIG. 4 in which a permanent magnet field two brush motor 18A is provided with transistor switching acting to connect and disconnect the power supply at high frequency and a "flywheel" diode 40 connected across the motor brushes which ensures that current continues to flow in the motor during the isolated periods. The periods of connection and disconnection determine the average voltage applied to the motor so setting its speed. While this arrangement can provide a wider speed range than can be obtained with the third brush motor and reduces motor losses at the higher speeds the initial cost is higher than the third brush arrangement, thus the latter may be preferred for many applications.

In the circuit shown in FIG. 4 the temperature controlled operation of the motor is effected electronically through a control circuit 41 and electronic power switch 42 instead of the changeover relay 37 of FIG. 2, but the operation is otherwise as previously described under the control of the first temperature responsive switch 33 in series with the ignition switch 35 and the second temperature responsive switch 34 operating independently of the ignition switch.

It is contemplated that electronic circuitry could be provided which would enable continuously variable speed running of the pump/fan motor which might have advantages in some arrangements in enabling the water pump and fan speed to be progressively increased as the coolant temperature increased to obtain some increase in efficiency by maintaining power consumption at the minimum necessary for effective cooling under substantially all operating conditions.

However, in many cases the additional savings in fuel would not justify the additional costs of such a control circuit.

Additional or "back-up" cooling might be provided by an independent electrically driven fan operating along side fan 20 and this could be controlled by one or other of the switches 33, 34 or have its own independent thermostatic control in known manner.

While various arrangements for operation of the fan/-pump motor may be employed it is preferred that the unit is switched off as described above during the initial warm-up period of the engine following a cold start, indeed it is contemplated that the motor might be "shorted" out to prevent a windmilling action of fan 20 driving the pump during this period.

It is normal practice to fit a wax capsule or bimetallic type of thermostat to prevent or restrict the flow of water through the radiator during warm-up to promote the most rapid increase in temperature as the engine operates more efficiently at its normal operating temperature.

When the engine is cold, it is necessary to use the choke on the carburettor, which increases the fuel flow and causes a very large increase in fuel consumption.

This thermostat will also ensure that the heater receives hot water at the earliest time following a cold start.

Depending on the particular design of engine, it may be possible to obtain an adequate flow of water to the heater unit by thermosyphoning enabling the pump to remain inoperative during warm-up.

Figure 3:
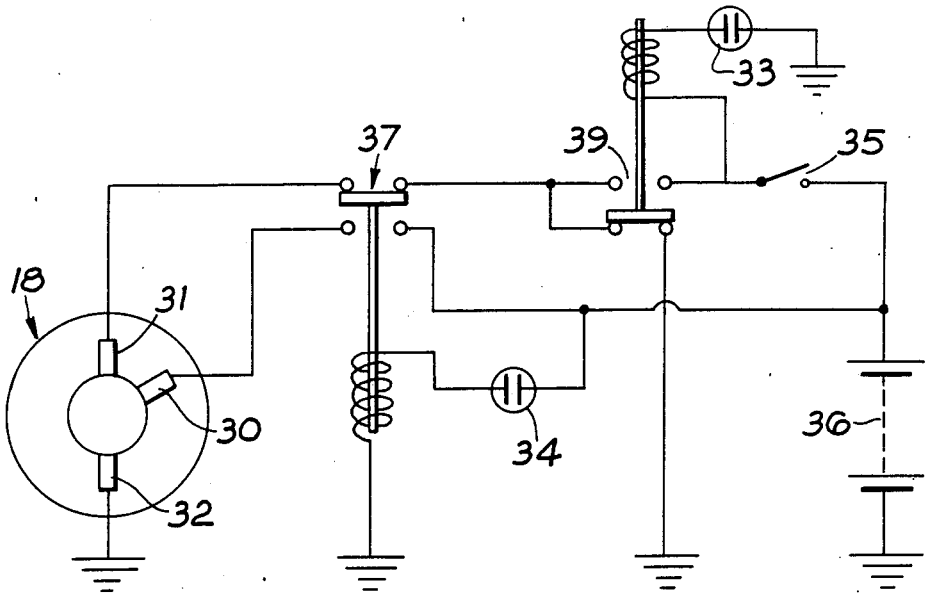
FIG. 3 is a modified form of said circuit diagram.

FIG. 3 is a modification of the circuit of FIG. 2 including a provision for earthing the running brush 31 to prevent said windmilling. By shorting the voltage otherwise generated across the brushes of a permanent magnet motor if it is rotatably driven a current will flow (limited by the assistance of the motor) which "loads" the motor and resists rotation at more than a few hundred r.p.m. In FIG. 3 a second relay 39 is provided whose solenoid is energised only when the first temperature responsive switch 33, connected through ignition switch 35, closes at normal operating temperature. This changes over the contacts of relay 39 to pass current through relay 37, as described above, to brush 31. At temperatures below said normal contacts of relay 39 connect brush 31 to earth i.e. brushes 31 and 32 are shorted.

The performance and advantages of the arrangements described above will now be further discussed in comparison with the most commonly employed known engine cooling systems.

Figure 5:
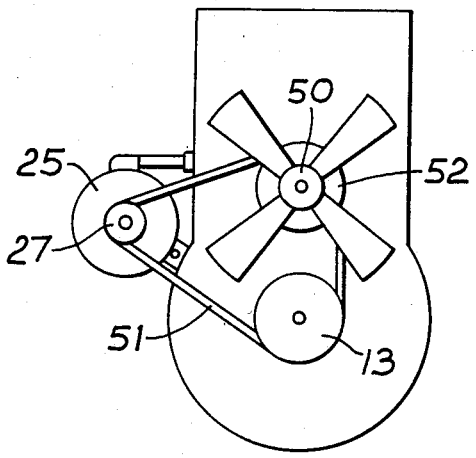
FIGS. 5 and 6 are end elevations on two known forms of belt drive arrangement for engine cooling and generator systems.

FIG. 5 is a diagrammatic front end view of an engine having a conventional front mounted belt-driven water pump and fan 50 continuously driven in common with generator 25 by a Vee belt 51 which has to run in triangular formation around the crank shaft pulley 13 generator pulley 27 and water pump/fan pulley 52. If generator 25 is an alternator as is now commonly the case it will be run at higher speeds than a dynamo so that a smaller pulley 27 is used. This has necessitated increased belt tension for effective transfer of power because the wrap angle, i.e. extent of peripheral engagement of the pulleys by the belt is severely limited by the triangulated drive layout.

Increased belt tension added to power losses already incurred by the needless continuous running of the fan and severely increased stress on the bearings of the alternator and water pump, the necessary enlargement of these bearings led to further power losses and, as mentioned previously the positioning of the fan severely restricts the manner in which radiator layout and arrangement of other auxiliary components can be made, these limitations being particularly unsatisfactory with transverse engine vehicles.

Figure 6:
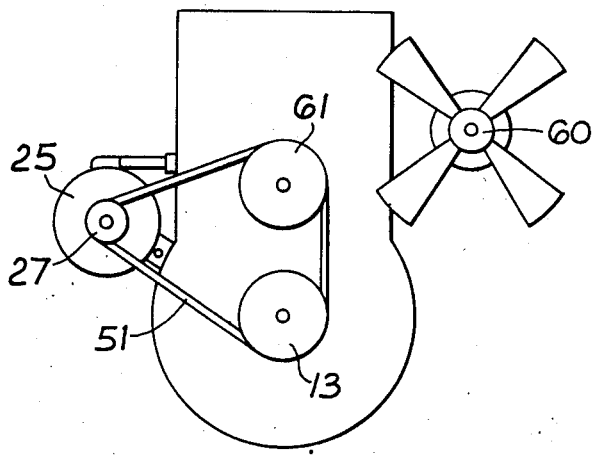

FIG. 6 shows the commonly employed alternative arrangement in which a separate electrically powered thermostatically controlled fan 60 is provided. While this is shown in the diagram with its axis parallel to the engine crankshaft it can, of course, be disposed in any postion e.g. to face a front mounted radiator of a transverse engine. This does provide power saving because it is usually found that the fan hardly needs to operate at all under winter conditions and in summer it may run for up to only about 20% of vehicle usage time or maybe 30% in hot climates. This arrangement still leaves the separate water pump 61 at the front of the engine driven continuously by the triangulated drive belt 51 giving rise to nearly all the problems and disadvantages referred to above with reference to FIG. 5.

The water pump in these known constructions is designed to run continuously at approximately engine speed and has to be designed to provide a flow rate adequate for circulation under the most adverse cooling conditions at a relatively low engine speed, for example 2000–3000 rpm. It must also be able to maintain sufficient flow at idling speed to prevent boiling (in some cases the latter condition proves the most difficult to satisfy). There may not be sufficient natural convective flow of coolant to allow the engine to operate without the pump running due to danger of localised hot spots in the engine block which could cause damage without forced circulation. A wax operated or other type of automatic theremostatic valve is normally incorporated in the cooling circuit to provide rapid warm up to operating temperature from a cold start for improved fuel economy and reduction of engine wear.

As referred to previously the use of a separate electric motor to drive the water pump has been proposed and, to avoid hot spots as referred to above, this may still have to be continuously driven. It would be beneficial from the point of view of fast warm up, increased efficiency and consequent fuel saving, if the water pump was not run until operating temperature is achieved or approached and such an arrangement could enable the conventional thermostatic valve which restricts water flow during warm up to be dispensed with.

In some installations the thermostat valve is essential to ensure an adequate flow of water through the heater matrix and could not be eliminated in such cases.

With the arrangement of the invention, as shown in FIG. 1, power losses in the front end belt drive are very substantially reduced because it will be seen that there is more than adequate "wrap angle" in the direct engagement of the Vee belt around the two pulleys of the crank shaft and generator, thus belt tension can be substantially reduced and the generator bearings are not highly stressed. Incidentally belt wear and maintenance to maintain tensioning will also be substantially reduced.

EXAMPLE A

With the known belt drive arrangement shown in FIGS. 5 and 6 power losses measured on a motorcar in use were found to be as follows:

| Type of driving conditions | Water pump power watts | Additional belt loss watts | Time % | Watts × time |
|---|---|---|---|---|
| Motorway | 514 | 75 | 15 | 77 + 11 |
| Urban/Suburban | 230 | 55 | 50 | 115 + 30 |
| City | 124 | 40 | 35 | 43 + 14 |
| | | Water pump power = | | 235 + 55 = 290 watts |

Although present water pumps require an average of 100 to 400 watts, this is due to their very low efficiency as they are designed with large clearances to prevent excessive flow and cavitation at high speeds and with large bearings to withstand the high belt tension and low belt lap angles. A water pump designed for efficiency over a much smaller speed range e.g. from 1500–2500 rpm, would require only 20–40 watts at 1500 rpm rising to 40–80 watts at 2500 rpm depending on the design and size of the engine and radiator.

Using a two motor arrangement (a pump and a fan driven by respective electric motors), a two speed thermostatically controlled motor driven pump could be run at around 1500 rpm and be switched to run at 2500 rpm when the water temperature approached the safe maximum. Assuming that this occured for 20% of the operating time, that the efficiency of the motor is 70% at 1500 rpm and 50% at 2500 rpm, and that the provision of electric power by the generator is at an overall efficiency of 50%, the engine output required for the largest water pump envisaged would be:

$$0.8 \times 40 \times \frac{1}{0.7} \times \frac{1}{0.5} + 0.2 \times 80 \times$$

-continued $$\frac{1}{0.5} \times \frac{1}{0.5} = 92 + 64 = 156 \text{ watts}$$

which compares with 290 watts required to drive the water pump via the belt. The saving would be 134 watts which depending on the size and design of vehicle would offer a fuel saving of about 1.5%.

If the pump motor were not a two speed thermostatically controlled unit, the power required to drive it continuously would amount to $$80 \times \frac{1}{0.7} \times \frac{1}{0.5} = 228 \text{ watts.}$$

This provides only a small saving in engine power requirement (i.e. 290−228=62 watts) and could cause considerable extra load on the alternator which might therefore need to be a larger unit. A continuously driven single speed motor driving the water pump is therefore not a viable proposition.

If, instead of the two motor arrangement, the pump/fan unit of the invention is used, using a purpose designed water pump for operation at the much smaller speed range referred to above, and with the dual speed operation of the pump/fan motor at 1500 and 2500 rpm, ignoring the warm-up periods, the total power required would be $$0.8 \times 50 \times \frac{1}{0.7} \times \frac{1}{0.5} \times 0.2 + 120 \times$$

$$\frac{1}{0.5} \times \frac{1}{0.5} = 115 + 96 = 211 \text{ watts}$$

This can be compared with the power required to drive the water pump by the belt and the power to drive the radiator cooling fan by an electric motor (FIG. 6);

$$290 + 0.2 \times 40 \times \frac{1}{0.7} \times \frac{1}{0.5} = 290 + 23 = 313 \text{ watts}$$

The combined water pump and fan therefore shows a saving of 313−211=102 watts which depending on the type of vehicle and use would allow a fuel consumption reduction of around $1\frac{1}{4}$% compared with the FIG. 6 arrangement.

Whilst this would appear to offer less saving in fuel than that which might be obtained by using two separate motors to drive the fan and pump respectively it must be remembered that preferred arrangements of the fan in the vehicle airstream provides assistance to the motor during periods of operation at medium to high vehicle speeds, and at these speeds it is unlikely that high speed pump/fan operation is ever required. Assuming that half of the time period of low fan and water pump speed is assisted by vehicle movement to provide an average of 25 watts of power from the fan, the motor is required to provide only 25 watts. The engine power required is therefore:

$$0.4 \times 25 \times \frac{1}{0.7} \times \frac{1}{0.5} + 0.4 \times 50 \times \frac{1}{0.7} \times \frac{1}{0.5} + 0.2 \times 120 \times \frac{1}{0.5} \times \frac{1}{0.5} =$$

$$28.5 + 57 + 96 = 181 \text{ watts}$$

giving a saving of 313−181=132 watts which is the same as might be obtained with the two motor arrangement i.e., a fuel saving of approximately $1\frac{1}{2}$%. Thus while the fuel saving is not necessarily any greater than with the two motor arrangement there is also economy in equipment cost, a saving in weight and space, and the facility for more flexible and convenient arrangement of components using the pump/fan unit.

EXAMPLE B

In another example, a smaller vehicle, the belt drive water pump consumes an average of only 170 watts of engine power. An electrically driven water pump and fan would require 30 watts for the water pump and 10 watts for the fan (40 watts total) during low speed (1500 rpm) motor operation (80% of the time) and would require 60 watts to drive the water pump and 40 watts to drive the fan (100 watts total) during high speed (2500 rpm) motor operation. Assuming that half the slow speed operation of the motor is at medium to high vehicle speeds when the fan provides assistance to the motor and reduces its load by 50%, the resulting engine load would be:

$$0.4 \times 20 \times \frac{1}{0.7} \times \frac{1}{0.5} + 0.4 \times 40 \times \frac{1}{0.7} \times \frac{1}{0.5} + 0.2 \times 100 \times \frac{1}{0.5} \times \frac{1}{0.5} =$$

$$23 + 45.5 + 80 = 148.5 \text{ watts}$$

This is to be compared with a conventional belt driven water pump and electric motor driven fan (as in FIG. 6) requiring $$170 + 0.2 \times 40 \frac{1}{0.7} \times \frac{1}{0.5} = 193 \text{ watts}$$

giving a engine load saving of 44.5 watts which for the smaller engine would provide a fuel saving of $\frac{3}{4}$%.

The comparison of performance of examples of the various types of system discussed above is set out in the following table:

Table Showing Different Fan and Water Pump Arrangements:

| | Engine Power Required - watts | | | |
|---|---|---|---|---|
| | Example A | | Example B | |
| *Conventional water pump and conventional motor driven fan | 290<br>23<br>313 | cf*<br><br>— | 170<br>23<br>193 | cf*<br><br>— |
| Continuously driven water pump (single speed motor) and conventional motor driven fan | 228<br>23<br>251 | −62 | 171<br>23<br>194 | +1 |
| Thermostatically controlled 2 speed motor driving water pump and conventional motor driven fan | 156<br>23<br>179 | −134 | 127<br>23<br>150 | −43 |
| Single, thermostatically controlled, 2 speed motor driving water pump and fan | 211 | −102 | 170 | −23 |
| Single, thermostatically controlled, 2 speed motor driving water pump and fan but allowing for vehicle movement to provide "windmilling" power | 181 | −132 | 148.5 | −44.5 |

Thus using the preferred arrangement of low cost dual speed three brush pump/fan motor with the fan providing assistance to the motor at least at medium to high vehicle speeds, a purpose designed pump, and with the pump/fan only operating at temperatures at or above normal operating level, a useful saving in power and hence fuel saving is achieved at acceptable equipment cost and with the advantages of flexible engine component and ancilliary unit layout and efficient generator drive.

Having now described my invention what I claim is:

1. A cooling system for a heat engine including a pump for forced circulation of coolant in a coolant flow circuit of the engine and a cooling fan for assisting in dispersal of heat from the coolant characterised by a common electric pump/fan motor driving the pump and fan in use, and by control means including sensor means responsive to temperature of the coolant in use for controlling operation of the motor automatically as a function of said temperature, wherein said motor is a variable speed, two-speed motor operating at a low speed when the coolant is below a first predetermined temperature and at a high speed when it is above that temperature, said motor further comprising a three brush motor.

2. A cooling system for a heat engine including a pump for forced circulation of coolant in a coolant flow circuit of the engine and a cooling fan for assisting in dispersal of heat from the coolant characterised by a common electric pump/fan motor driving the pump and fan in use, and by control means including sensor means responsive to temperature of the coolant in use for controlling operation of the motor automatically as a function of said temperature, wherein said motor is a variable speed motor, wherein said control means includes means for varying the operating speed of the motor having switching means operably connecting and disconnecting the motor power supply at high frequency and a diode connected across brushes of the motor to provide continuation of current flow in the motor during the periods of disconnection, the speed of operation being determined by selective adjustment of the frequency of said connection and disconnection.

3. A system as in claim 2 characterised in that the motor is a two-speed motor operating at a low speed when the coolant is below a first predetermined temperature and at a high speed when it is above that temperature.

4. A system as in claim 3 characterised in that the control means acts to render the motor inoperative at or below a second predetermined temperature substantially below the first temperature.

5. A cooling system for a heat engine including a pump for forced circulation of coolant in a coolant flow circuit of the engine and a cooling fan for assisting in dispersal of heat from the coolant characterised by a common electric pump/fan motor driving the pump and fan in use, and by control means including sensor means responsive to temperature of the coolant in use for controlling operation of the motor automatically as a function of said temperature further including means for restraining free rotation of the motor when no driving current is being applied thereto in use so that operation of the pump due to passage of air through the fan is also restrained.

6. A system as in claim 5 wherein the motor is a brush-type motor characterised in that said means for restraining rotation includes switching means shorting the brushes at temperatures below a predetermined level.

7. A cooling system for a heat engine including:

a pump for forced circulation of coolant in a coolant flow circuit of the engine;

a cooling fan for assisting in dispersal of heat from the coolant;

a common electric variable speed pump/fan motor having brushes and for driving both the pump and fan in use; and automatic speed regulation means for controlling operation of said motor automatically as a function of the temperature of the coolant in use, said speed regulation means comprising:

sensor means responsive to said temperature;

switching means operably connecting and disconnecting a power supply to and from said motor at high frequency; and a diode connected across said brushes of the motor to provide continuation of current flow in the motor during the periods of disconnection, said switching means, responsive to said sensor means, for changing periods of connection and disconnection and thus varying the speed of operation of said motor.

8. A cooling system for a heat engine including:

a pump for forced circulation of coolant in a coolant flow circuit of the engine;

a cooling fan for assisting in dispersal of heat from the coolant;

a common electric pump/fan motor driving the pump and fan in use;

control means including sensor means, responsive to temperature of the coolant in use, for controlling operation of the motor automatically as a function of said temperature; and means for restraining free rotation of the motor when no driving current is being applied thereto in use so that operation of the pump due to passage of air through the fan is restrained.

9. A cooling system for a heat engine including a pump for forced circulation of coolant in a coolant flow circuit of the engine;

a cooling fan for assisting in dispersal of heat from the coolant;

a common electric pump/fan motor having brushes and for driving the pump and fan in use; and control means including sensor means, responsive to temperature of the coolant in use, for controlling operation of the motor automatically as a function of said temperature, and switching means for shorting the motor brushes at temperatures below a predetermined level and restraining free rotation of the motor when no driving current is being applied thereto in use so that operation of the pump due to passage of air through the fan is restrained.

10. A system as in claim 8 or 9, wherein said motor is a two-speed motor operating at a low speed when said coolant is below a first predetermined temperature and at a high speed when said coolant is above said first predetermined temperature.

* * * * *